US008484764B2

(12) United States Patent
Damon et al.

(10) Patent No.: US 8,484,764 B2
(45) Date of Patent: Jul. 16, 2013

(54) ZIPPER ARRANGEMENT

(75) Inventors: Jonas K. Damon, New York, NY (US); Daniel A. Sanchez, Brooklyn, NY (US); Gregory Daniel Louis Germe, New York, NY (US); Kajsa Cornelia Anna Maria Westman, Skarpnack (SE); Jinseok Hwang, Palisade Park, NJ (US); Allison S. Conner, Brooklyn, NY (US)

(73) Assignee: Under Armour, Inc., Baltimore, MD (US)

( * ) Notice: Subject to any disclaimer, the term of this patent is extended or adjusted under 35 U.S.C. 154(b) by 276 days.

(21) Appl. No.: 12/947,646

(22) Filed: Nov. 16, 2010

(65) Prior Publication Data

US 2012/0042433 A1 Feb. 23, 2012

Related U.S. Application Data

(60) Provisional application No. 61/374,958, filed on Aug. 18, 2010.

(51) Int. Cl.
*A41D 1/02* (2006.01)
*A44B 19/00* (2006.01)

(52) U.S. Cl.
USPC ..... 2/96; 2/108; 24/386; 24/390

(58) Field of Classification Search
USPC ..... 2/96, 108, 93, 94, 85, 86, 69, 2.17, 2/79, 89, 115, 243.1, 69.5; 24/386, 387, 388, 24/390, 385, 381, 383
See application file for complete search history.

(56) References Cited

U.S. PATENT DOCUMENTS

| | | | | | |
|---|---|---|---|---|---|
| 1,990,311 | A | * | 2/1935 | Salwen | 2/234 |
| 2,146,714 | A | * | 2/1939 | Austin | 24/433 |
| 2,224,930 | A | * | 12/1940 | Roseman | 24/381 |
| 2,263,481 | A | | 11/1941 | Austin | |
| 2,463,937 | A | * | 3/1949 | Austin | 24/433 |
| 2,889,605 | A | | 6/1959 | Morin | |
| 3,605,208 | A | * | 9/1971 | Carlile | 24/390 |
| 4,142,275 | A | | 3/1979 | Krauer | |
| 4,232,429 | A | | 11/1980 | Friedberg | |
| 4,261,082 | A | | 4/1981 | Kamiya | |
| 4,309,798 | A | | 1/1982 | Fraga | |
| 4,507,805 | A | * | 4/1985 | Calutoiu | 2/69.5 |
| 4,713,946 | A | | 12/1987 | Hoerkens | |
| 4,819,308 | A | | 4/1989 | Baroky | |
| 4,922,585 | A | | 5/1990 | Suzuki et al. | |
| 4,997,222 | A | | 3/1991 | Reed | |
| 5,020,247 | A | | 6/1991 | Barret et al. | |

(Continued)

*Primary Examiner* — Amy Vanatta
(74) *Attorney, Agent, or Firm* — Maginot, Moore & Beck LLP

(57) ABSTRACT

A zipper arrangement is configured to fasten a first fabric portion to a second fabric portion. The zipper arrangement includes a plurality of first zipper elements positioned along the first fabric portion and a plurality of second zipper elements positioned along the second fabric portion. A zipper closure includes a first closure member releasably coupled to a second closure member. The first closure member is positioned on a mid-portion of the first fabric portion and the second closure member is positioned on a mid-portion of the second fabric portion. A first slider is positioned on one side of the zipper closure and a second slider positioned on an opposite side of the zipper closure. When provided on a garment, the zipper arrangement may be used in association with a method for fastening a first garment portion to a second garment portion by moving the sliders in opposing directions.

12 Claims, 9 Drawing Sheets

U.S. PATENT DOCUMENTS 5,079,809 A 1/1992 Teich et al.
5,081,747 A 1/1992 Takizawa et al.
5,181,299 A 1/1993 Huang
5,497,535 A 3/1996 Kloor
5,697,130 A 12/1997 Smith
5,836,058 A * 11/1998 Cullum ..... 24/401
5,940,941 A 8/1999 Dishner et al.
5,956,819 A 9/1999 Terasaki et al.
5,983,465 A 11/1999 Wakai et al.
6,026,546 A 2/2000 Lund et al.
6,026,547 A 2/2000 O'Donnell Kiely
6,088,888 A * 7/2000 Oda ..... 24/433
6,119,270 A * 9/2000 Chou ..... 2/108
6,182,338 B1 2/2001 Watanabe
6,243,926 B1 6/2001 Takashima et al.
6,279,209 B1 8/2001 Kang
6,430,785 B1 8/2002 Matsushima et al.
6,453,521 B1 9/2002 Dischler
6,490,770 B1 12/2002 Matsuda et al.
6,499,200 B1 12/2002 Yamagishi et al.
6,536,084 B2 3/2003 Davis
6,571,432 B1 6/2003 Rindle
6,588,072 B1 7/2003 Lin
6,604,263 B1 8/2003 Dischler
6,681,456 B1 1/2004 Dischler
6,701,584 B2 3/2004 Metzger
6,832,415 B2 * 12/2004 Higginbotham et al. ..... 24/399
6,851,162 B2 2/2005 Yuki et al.
6,976,293 B2 12/2005 Traulle et al.
7,017,242 B2 3/2006 Bernasconi
7,036,190 B2 5/2006 Demarest
7,036,192 B2 * 5/2006 Yoneoka ..... 24/443
7,043,802 B2 5/2006 Moeller et al.
7,111,714 B1 9/2006 Bell, III
7,114,224 B2 10/2006 Kondo et al.
7,137,177 B2 11/2006 Fujii et al.
7,152,438 B2 12/2006 Matsuda
7,188,395 B2 3/2007 Kondo et al.
7,200,900 B2 4/2007 Berns
7,204,001 B2 4/2007 Lin
7,293,334 B2 11/2007 Metzger
7,313,847 B1 1/2008 Felix et al.
7,353,570 B2 4/2008 Himi
7,404,240 B2 7/2008 Nedbal et al.
7,621,025 B2 11/2009 Sanna
7,665,194 B2 2/2010 Iwase
2001/0004787 A1 6/2001 Nagata et al.
2003/0056342 A1 3/2003 Iwase et al.
2003/0177616 A1 9/2003 Petravic et al.
2004/0020017 A1 2/2004 Nedbal et al.
2004/0074059 A1 4/2004 Traulle et al.
2004/0088834 A1 5/2004 Yu
2004/0117954 A1 6/2004 Lin
2004/0148745 A1 8/2004 Moeller et al.
2005/0102803 A1 5/2005 Wen et al.
2005/0166371 A1 8/2005 Tseng et al.
2005/0204516 A1 * 9/2005 Leva et al. ..... 24/385
2005/0204517 A1 9/2005 Demarest
2006/0112523 A1 6/2006 Deto et al.
2006/0218758 A1 10/2006 Chang
2006/0242804 A1 11/2006 Griffiths
2007/0107171 A1 5/2007 Kojima
2007/0135953 A1 6/2007 Crow
2007/0289110 A1 12/2007 Bekeschus
2008/0155797 A1 7/2008 Tamura
2008/0209695 A1 9/2008 Matsui et al.
2008/0222854 A1 9/2008 Keyaki et al.
2009/0013505 A1 1/2009 Hasegawa et al.
2009/0049659 A1 2/2009 Takani et al.
2009/0056086 A1 3/2009 Ujihara et al.
2009/0077774 A1 3/2009 Lee et al.
2009/0094805 A1 4/2009 Keyaki et al.
2009/0229090 A1 9/2009 Cossutti et al.
2009/0320250 A1 12/2009 Yamamoto et al.
2010/0005557 A1 1/2010 Cossutti et al.
2010/0313387 A1 * 12/2010 Peters et al. ..... 24/381

* cited by examiner

ZIPPER ARRANGEMENT

CROSS-REFERENCE TO RELATED APPLICATIONS

This application claims priority from U.S. Provisional Patent Application No. 61/374,958, filed Aug. 18, 2010.

FIELD

This application relates to the field of fastening devices, and particularly to zipper arrangements.

BACKGROUND

Zippers are commonly used to fasten opposing fabric portions. One typical use for zippers is to close two separate fabric portions on the front of a garment such as a coat or jacket.

When closing a garment using known zipper arrangements on the front of a garment, the wearer must locate a zipper closure at the bottom of the garment and couple a small insertion pin on one side of the zipper to a retaining box on the opposite side of the zipper. The small size of the insertion pin and retaining box often makes it difficult to quickly couple the two parts. This is especially true when the garment is bulky, such as a winter coat. The wearer may also be wearing gloves, further limiting the wearer's ability to easily couple the insertion pin and retaining box. Moreover, the relatively remote location of the insertion pin and retaining box at the bottom of the garment may make it difficult for the wearer to see the parts. This is especially true if the parts are somewhat blocked from view by a bulky garment, or if the wearer has poor eyesight.

When opening the garment with a known front zipper arrangement, the wearer must first locate and grasp a small pull on the zipper slider near the neck. The pull may then be used to move the slider downward to release the teeth from their interlocking engagement. However, locating the zipper pull may be difficult if the garment is bulky or if the wearer is wearing gloves. Moreover, the pull may be close the wearer's neck if the garment is completely zipped, thus limiting the wearer's ability to see the pull.

In view of the foregoing, it would be advantageous to provide a zipper arrangement where the zipper closure may be more easily accessed and assembled by the wearer. It would also be advantageous if such zipper arrangement could be easily opened and closed by the wearer, even if the zipper is provided on a bulky garment.

SUMMARY

A zipper arrangement is configured to fasten a first fabric portion to a second fabric portion. The zipper arrangement comprises a plurality of first zipper elements positioned along the first fabric portion and a plurality of second zipper elements positioned along the second fabric portion. The zipper arrangement further includes a zipper closure comprised of a first closure member releasably coupled to a second closure member. The first closure member is positioned on a mid-portion of the first fabric portion and the second closure member is positioned on a mid-portion of the second fabric portion. A first slider is positioned on one side of the zipper closure and a second slider positioned on an opposite side of the zipper closure.

The zipper arrangement may be configured in numerous different embodiments and for numerous different applications. For example, in at least one embodiment, the plurality of first zipper elements are configured to engage the plurality of second zipper elements in a quick release interlock such that the first zipper elements may be released from the second zipper elements without the use of the first slider or the second slider. Furthermore, in at least one embodiment, the first closure member and the second closure member of the zipper closure are configured to be magnetically coupled.

In at least one embodiment, the zipper arrangement is provided on a garment. When provided on a garment, the zipper arrangement may be used in association with a method for fastening a first garment portion and a second garment portion. The method comprises coupling the first closure member of the zipper closure to the second closure member of the zipper closure. The method further comprises sliding the first slider in a first direction away from the zipper closure such that a first plurality of zipper elements are interlocked, and sliding the second slider in a second direction away from the zipper closure such that a second plurality of zipper elements are interlocked, the second direction being opposite the first direction. In at least one embodiment the first slider and the second slider are simultaneously slid in the first direction and the opposing second direction.

In addition to the foregoing, in at least one embodiment the method further comprises releasing the first garment portion from the second garment portion. To accomplish this, the first closure member is released from the second closure member, and the first garment portion is moved away from the second garment portion in the area of the zipper closure. As the first garment portion is moved away from the second garment portion, the configuration of the zipper elements is such that the plurality of first zipper elements are progressively unlocked from the plurality of second zipper elements. This progressive unlocking of zipper elements is accomplished without the use of the first slider or the second slider.

The above described features and advantages, as well as others, will become more readily apparent to those of ordinary skill in the art by reference to the following detailed description and accompanying drawings. While it would be desirable to provide a zipper arrangement that provides one or more of these or other advantageous features, the teachings disclosed herein extend to those embodiments which fall within the scope of the appended claims, regardless of whether they accomplish one or more of the above-mentioned features or advantages.

DESCRIPTION

Figure 1:
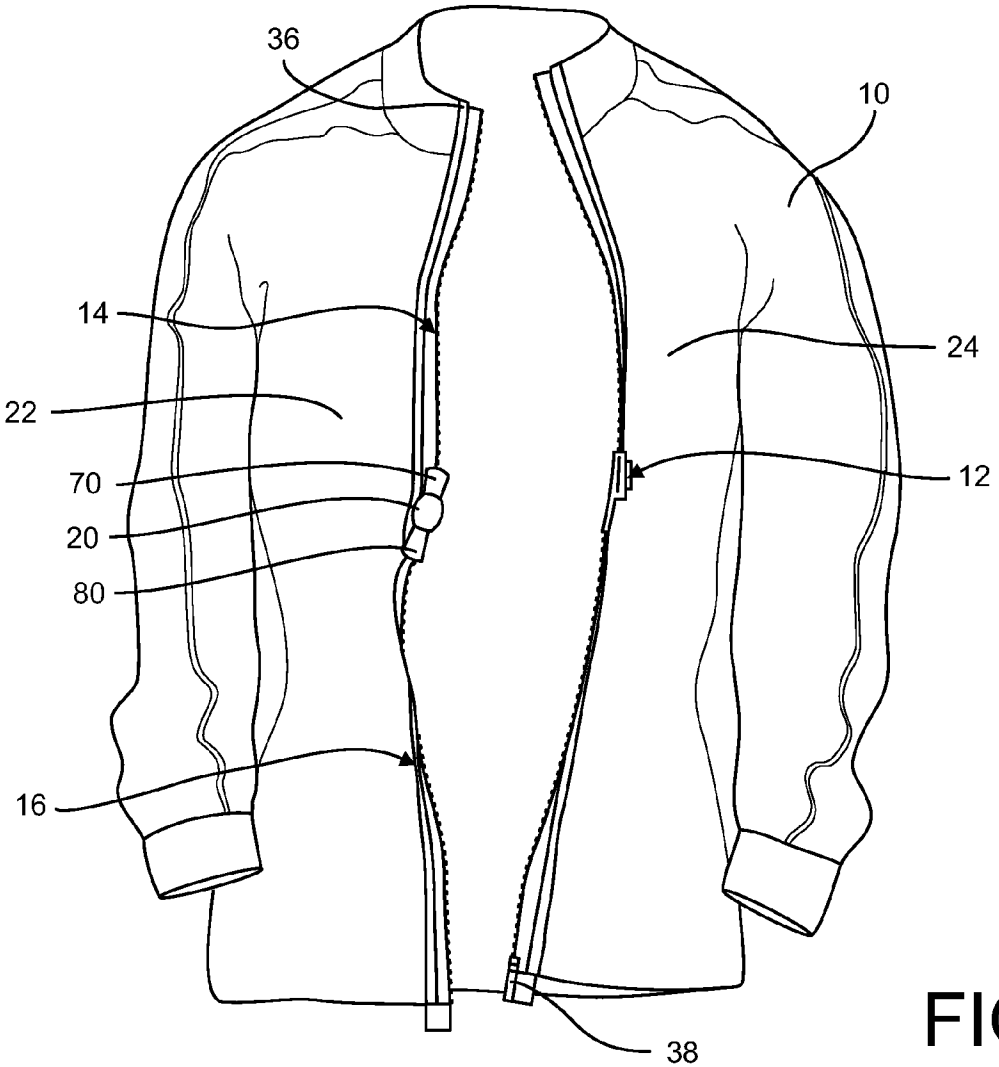
FIG. 1 shows a front view of a zipper arrangement provided on a garment with opposing sides of zipper uncoupled such that the garment is open.
Figure 2:
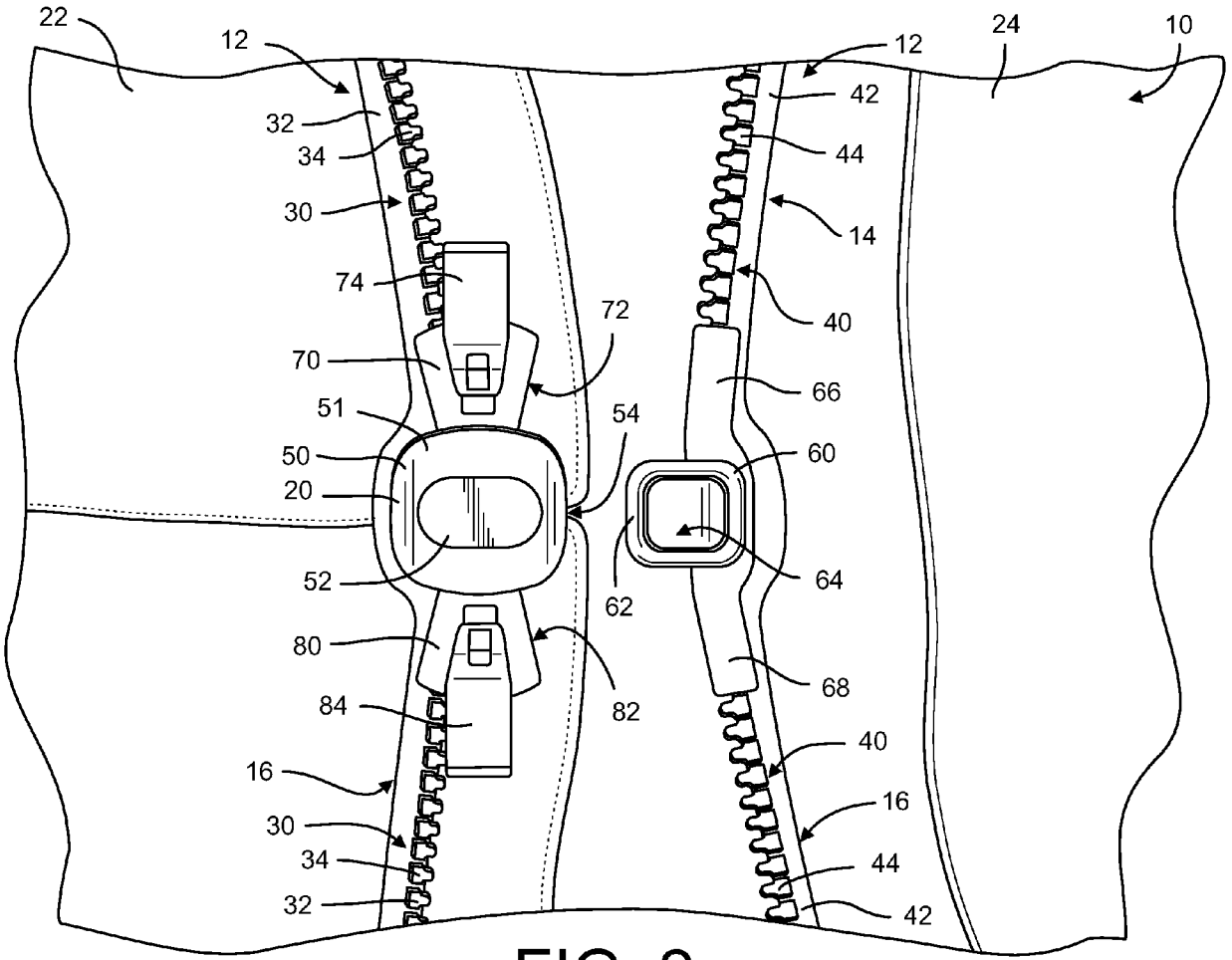
FIG. 2 shows a front view of a zipper closure for the zipper arrangement of FIG. 1.

With reference to FIGS. 1 and 2, a garment 10 is shown with a zipper arrangement 12 provided on the garment 10. The zipper arrangement 12 is provided on the front of the garment 10. The zipper arrangement 12 includes a zipper closure 20 in a middle portion of the garment 10. The zipper closure 20 generally divides the zipper arrangement 12 into an upper zipper portion 14 and a lower zipper portion 16. A first slider 70 is provided on the upper zipper portion 14 and a second slider 80 is provided on the lower zipper portion 16.

The garment 10 is shown in FIG. 1 in the form of a jacket including a front right portion 22 and a front left portion 24. The front right portion 22 and the front left portion 24 are generally separated from each other on the front of the front of the garment 10, but are configured to be fastened together with the zipper arrangement 12. When the front right portion 22 and front left portion 24 are separated, a wearer may easily insert his or her arms into the sleeves of the garment 10 and don the garment 10. The wearer may then use the zipper arrangement 12 to join the front right portion 22 to the front left portion 24. While the garment 10 has been shown in the embodiment of FIG. 1 as a jacket, it will be recognized that the garment 10 may take any of various other forms, such as a coat, shirt, pants, or any other garment that may have one or more portions with edges to be releasably coupled together with the zipper arrangement 12. Moreover, while the zipper arrangement 12 has been shown in the front of the garment in FIG. 1, it will recognized that the zipper arrangement 12 may be provided in any location on the garment 10 where the edges of two garment portions will be releasably coupled together.

Figure 7:
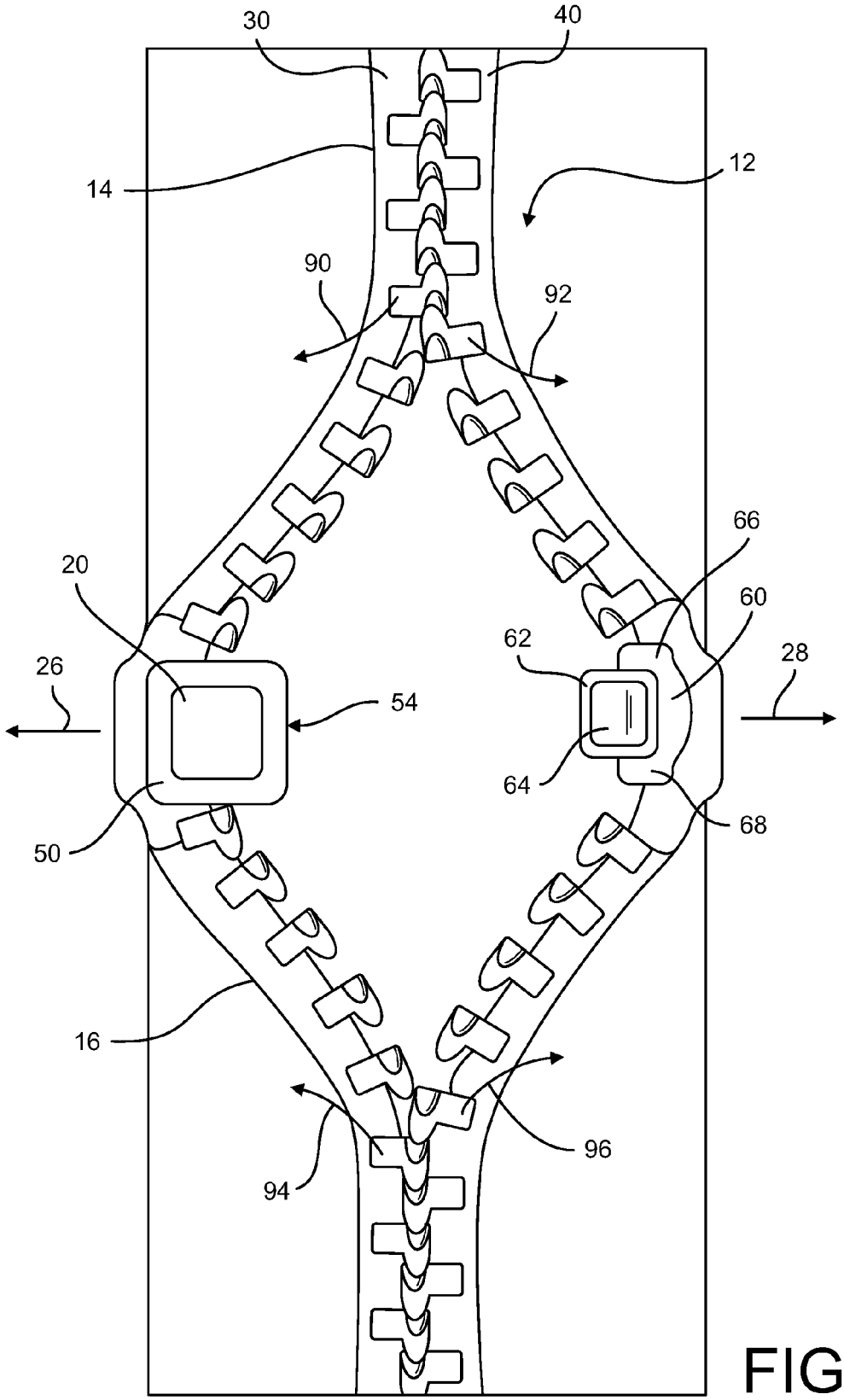
FIG. 7 shows a diagrammatic view of the zipper closure decoupled and opposing sides of the garment of FIG. 1 being moved away from one another in order to release the opposing sides of the zipper.

With reference now to FIG. 1, the zipper arrangement 12 includes two opposing sides 30 and 40. The right side 30 of the zipper arrangement 12 is coupled to an edge of the front right portion 22 of the garment 10, and the left side 40 of the zipper arrangement 12 is coupled to an edge of the front left portion 24 of the garment 10. The right side 30 includes a tape 32 with zipper elements 34 (which may also be referred to herein as "teeth") positioned along the length of the tape 32. Similarly, the left side 40 includes a tape 42 with zipper elements 44 positioned along the length of the tape 42. The zipper elements 34 on the right side 30 are generally parallel to each other and extend away from the tape 32 toward the left side 40 of the zipper arrangement 12. Similarly, the zipper elements 44 on the left side 40 are generally parallel to each other and extend away from the tape 42 toward the right side 30 of the zipper arrangement 12. The zipper elements 34 on the right side 30 are configured to interlock with the zipper elements 44 on the left side 40 when the zipper arrangement 12 is closed and thereby couple the right front portion 22 of the garment 10 to the left front portion 24 of the garment 10. In addition, as explained in further detail below with reference to FIG. 7, the zipper elements 34 and 44 are configured as quick release teeth that may be separated without the use of the slider.

With continued reference to FIGS. 1 and 2, the zipper closure 20 is provided in a mid-area of the garment 10 and divides the zipper arrangement 12 into the upper zipper portion 14 and the lower zipper portion 16 in a mid-area of the garment 10. In the embodiment of FIGS. 1 and 2, the zipper closure 20 is provided in two parts including a right closure member 50 and a left closure member 60. The right closure member 50 is fixed to the front right portion 22 of the garment 20, and the left closure member 60 is fixed to the front left portion 24 of the garment.

In the embodiment of FIGS. 1 and 2, the right closure member 50 includes a retaining box structure 51 with a release button 52 positioned thereon. A side opening (indicated by arrow 54) is provided in the side of the retaining box structure 51. The side opening 54 provides a slit that is large enough to receive at least a portion of the left closure member 60. A catch (not shown) is provided on the interior of the retaining box 51 of the right closure member 50. The release button 52 is configured to move the catch between a release position and a hold position.

The left closure member 60 includes a central tab member 62 that extends away from the left tape 42 of the zipper arrangement. The central tab member 62 includes a contoured surface 64 configured to engage the catch on the right closure member 50. The left closure member 60 further includes an upper insertion pin 66 and a lower insertion pin 68. The upper insertion pin 66 extends upward along the left tape 42 from the central tab member 62 to the left teeth 44 on the upper portion 14 of the zipper arrangement 12. Similarly, the lower insertion pin 68 extends downward along the left tape from the central tab member 62 to the left teeth 44 on the lower portion 16 of the zipper arrangement 12. The central tab member 62, upper insertion pin 66 and lower insertion pin 68 are sufficiently thin to fit within the opening 54 of the right closure member 50.

Figure 3:
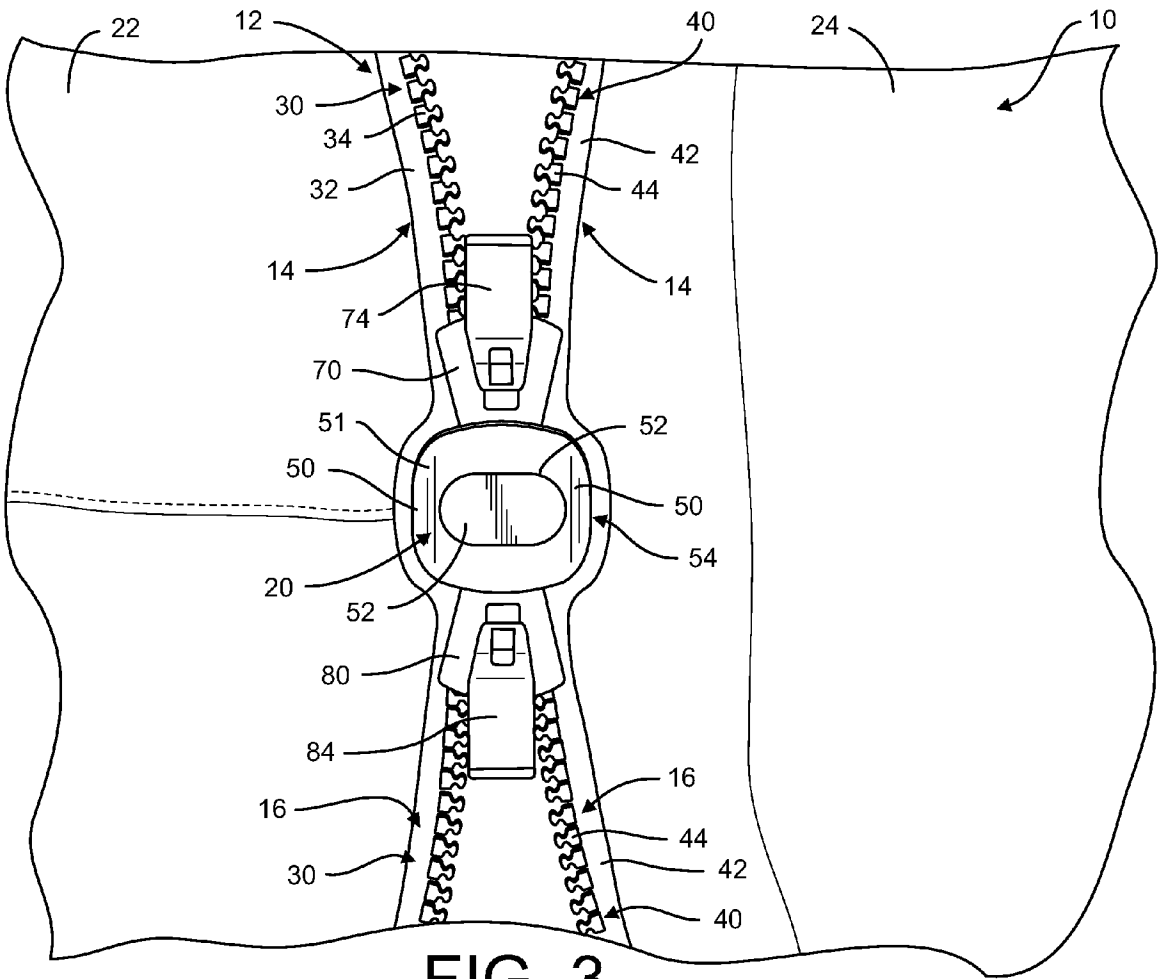
FIG. 3 shows a front view of the zipper closure of FIG. 2 with the opposing sides of the zipper joined at the zipper closure.
Figure 4:
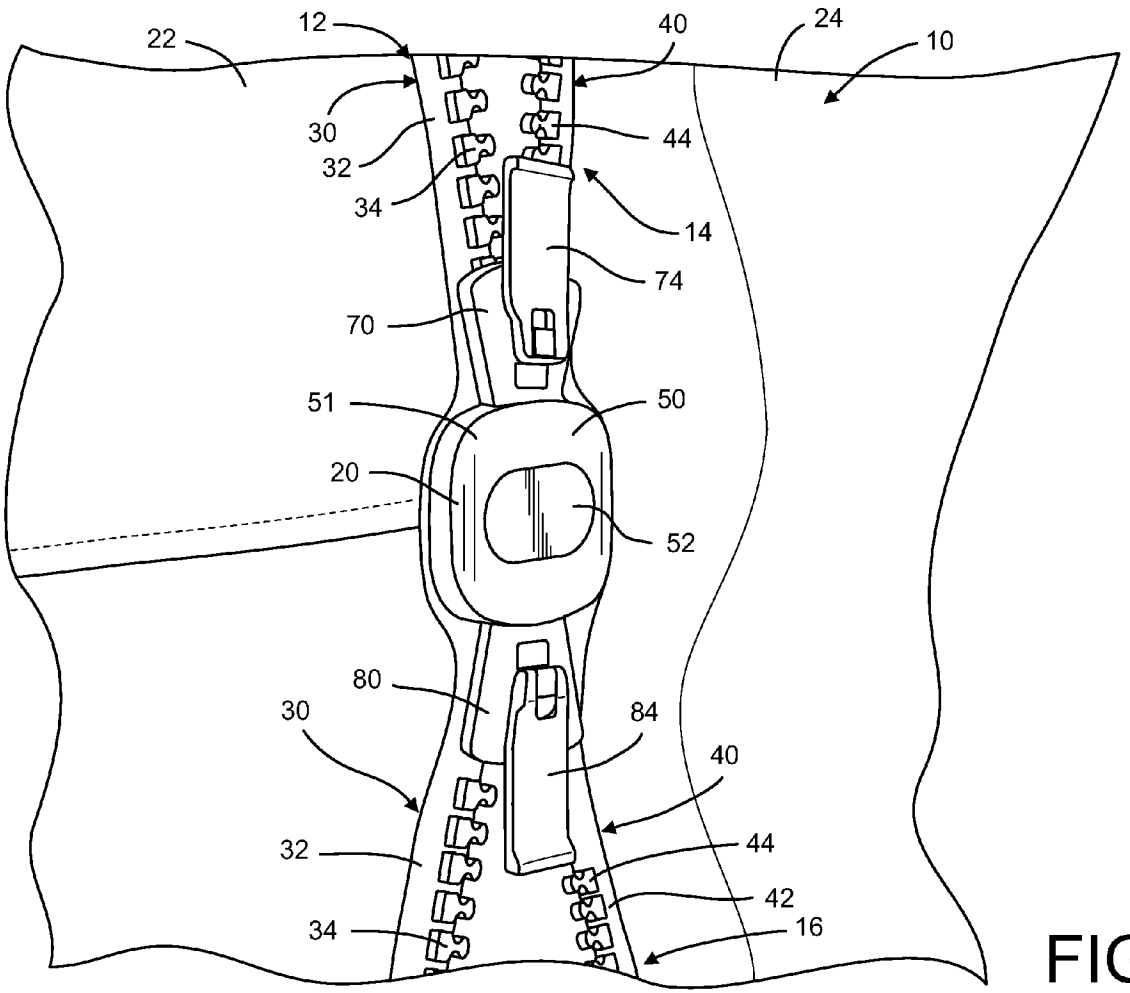
FIG. 4 shows a perspective view of the zipper closure of FIG. 3.

FIGS. 3 and 4 show the left closure member 60 positioned in the retaining box 51 of the right closure member 50. When inserted into the opening 54 to the retaining box 51, the contoured surface 64 of the central tab member 62 engages the catch of the right closure member 50, and the left closure member 60 is releasably held by the right closure member 50. Although the right closure member 50 and the left closure member 60 have been described herein as using a coupling mechanism with a catch and a release button, it will be appreciated that other coupling arrangements are possible, including the magnetic coupling arrangement described in further detail below with reference to FIGS. 8-10.

The zipper arrangement 12 further includes an upper slider 70 that slideably engages the right tape 32 on the upper side 14 of the zipper arrangement 12. The upper slider 70 includes a left side slit (indicated by arrow 72) designed and dimensioned to receive the upper insertion pin 66 on the left closure member 60. The upper slider 70 further includes a flared upper side and a tapered lower side with a Y-shaped interior channel extending between (see Y-shaped channel 75 in FIG. 5). The Y-shaped interior channel is configured to bring the zipper teeth 34 and 44 into interlocking engagement. A pull 74 is provided on the upper slider 70 to allow the wearer of the garment 10 to easily move the upper slider 70 up and down along the right tape 32 and the left tape 42.

Similarly, a lower slider 80 slideably engages the right tape 32 on the lower side 16 of the zipper arrangement 12. The lower slider 80 includes a left side slit (indicated by arrow 82) designed and dimensioned to receive the lower insertion pin 68 on the left closure member 60. The lower slider 80 further includes a tapered upper side and a flared lower side with an inverted-Y-shaped interior channel extending between (see inverted-Y-shaped channel 85 in FIG. 5). The inverted-Y-shaped interior channel is configured to bring the zipper teeth 34 and 44 into interlocking engagement. A pull 84 is provided on the lower slider 80 to allow the wearer of the garment 10 to easily move the lower slider 80 up and down along the right tape 32 and the left tape 42. The lower slider 80 may also include a coupling feature to mitigate the effects of gravity on the slider when the user attempts to place the lower slider against the zipper closure 20. For example, the lower slider 80 may be designed with features that allow the lower slider to engage the right coupling member 50 with a light friction fit. As another example, the lower slider 80 may include a light magnetic coupling with right coupling member 50.

Figure 5:
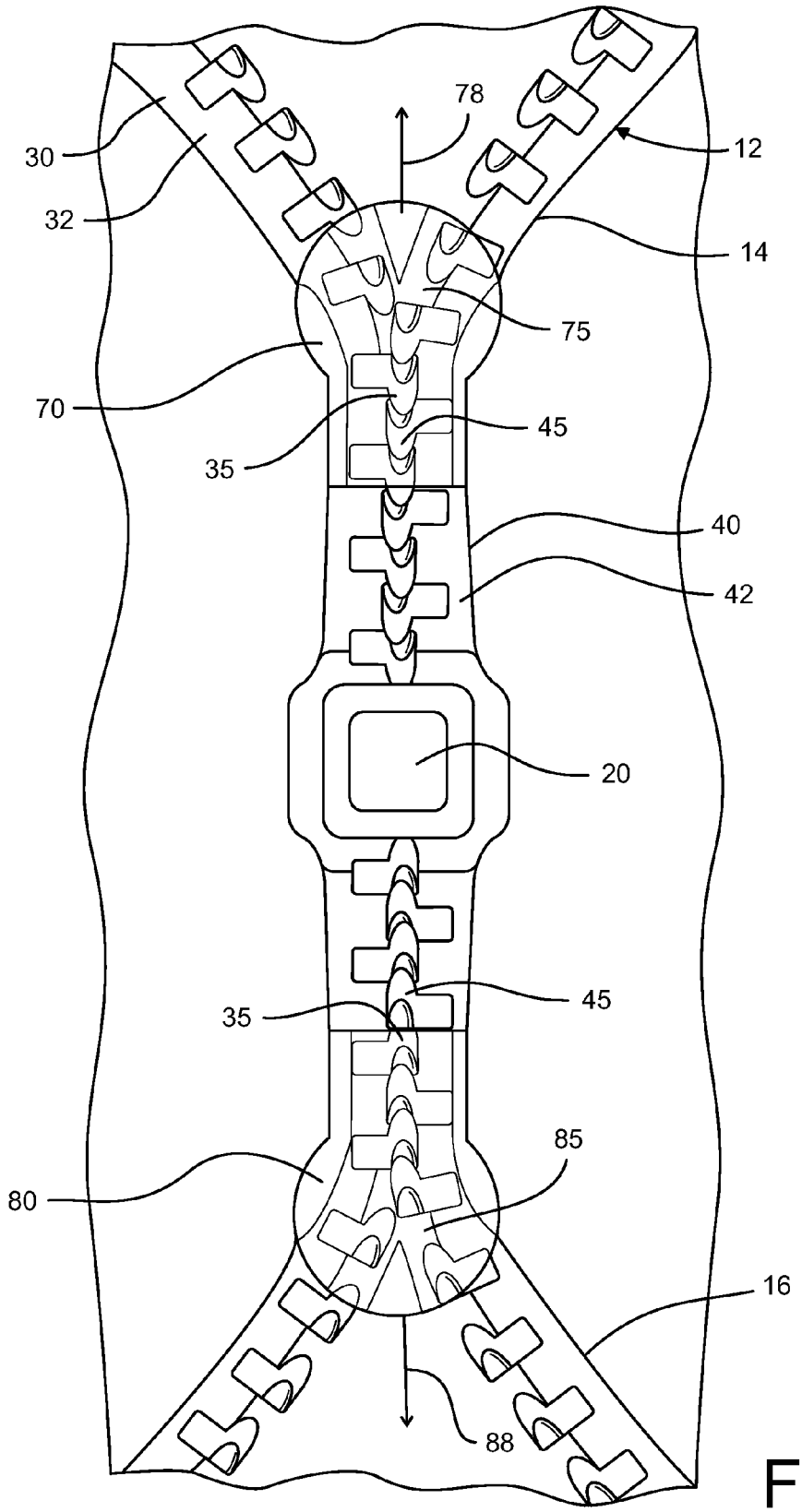
FIG. 5 shows a diagrammatic view of sliders on opposing sides of the zipper closure moving away from one another in order to couple the opposing sides of the zipper.

With reference now to FIGS. 3-5, the wearer of the garment 10 may couple the front right portion 22 of the garment 10 to the front left portion 24 using the zipper arrangement 12. To accomplish this, the wearer first moves the upper slider 70 and the lower slider 80 into contact with the right closure member 50 at the mid-portion of the garment. Once the sliders 70 and 80 are engaged with the right closure member 50, the wearer inserts the left closure member 60 into the side opening 54 of the right closure member 50 until the catch mechanism on the right closure member 50 engages the tab surface 64, thus coupling the left closure member 60 to the right closure member 50.

After coupling the left and right closure members 50, 60, the wearer may close the upper zipper portion 14 by sliding the upper slider 70 in the upward direction, as noted by arrow 78 in FIG. 5. This upward movement of the slider 70 progressively forces the teeth 34 and 44 on the upper zipper portion 14 into an interlocking engagement. In particular, as shown in FIG. 5, the teeth 34, 44 include hook shaped ends 35, 45, that nest together and interlock as the upper slider 70 is moved upward along the opposing tapes 32, 42. As illustrated in FIG. 5, as the upper slider 70 moves in the direction of arrow 78, the teeth 34, 44 move into the Y-shaped channel. Progressive upward movement of the upper slider 70 causes the teeth 34, 44 on alternating sides 30, 40 to mesh together within the Y-shaped channel. As the teeth 34, 44 are meshed together, they are oriented in a parallel relationship and interlocked within the Y-shaped channel. Continued movement of the upper slider 70 moves the interlocked teeth 34, 44 out of the tapered end of the slider 70. An upper stop 36 (see FIG. 1) prevents the upper slider 70 from moving past an upmost position on the zipper arrangement 12 and garment 10.

In a similar manner, the wearer may also close the lower zipper portion 16 by sliding the lower slider 80 in the downward direction, as noted by arrow 88 in FIG. 5. This downward movement of the slider 80 progressively forces the teeth 34 and 44 on the lower zipper portion 16 into an alternating interlock engagement. A lower stop 38 (see FIG. 1) prevents the lower slider 80 from moving past a bottom position on the zipper arrangement 12 and garment 10.

Figure 6:
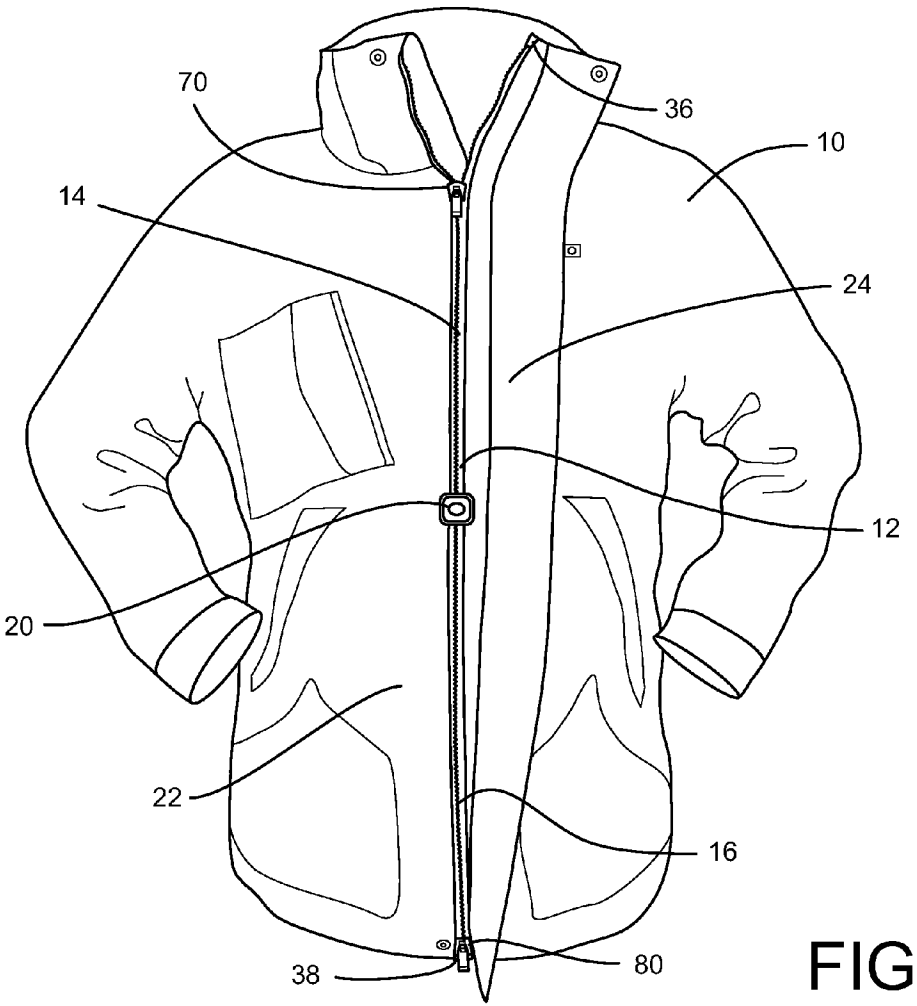
FIG. 6 shows a front view of the zipper arrangement on the garment of FIG. 1 with the opposing sides of the zipper arrangement coupled together and the garment closed.

As noted above, the upper slider 70 and the lower slider 80 operate independently to close different portions of the garment 10. In particular, the upper slider 60 may be used to close an upper portion of the garment 10, and the lower slider 80 may be used to zip a lower portion of the garment 10. However, when the upper slider 70 and lower slider 80 are moved in unison to close the garment (i.e., zip the garment), a dynamic gesture is made with the wearer's hands. In particular, when the upper slider 70 and lower slider 80 are moved in unison, an upper hand of the wearer moves up (zipping the upper portion 14 of the zipper arrangement 12) while the lower hand moves down (zipping the lower portion 16 of the zipper arrangement 12). Accordingly, the wearer's hands actually move in opposite directions as the garment 10 is zipped. A zipped garment 10 with the front left portion 22 of the garment 10 coupled to the front right portion 24 is shown in FIG. 6.

After the garment 10 is closed by zipping the zipper arrangement 12, the wearer may open the garment 10 by either (i) un-zipping the garment or (ii) using a quick-release feature incorporated into the zipper arrangement. If opening the garment by un-zipping, the wearer's upper hand grasps the pull 74 on the upper slider 70, and moves the upper slider in a downward direction, thus unzipping the upper portion 14 of the zipper arrangement 12. Before, after, or at the same time, the wearer's lower hand grasps the pull 84 on the lower slider 80, and moves the lower slider in an upward direction, thus unzipping the lower portion 16 of the zipper arrangement 12. After the upper slider 70 and the lower slider 80 are moved to the centrally located zipper closure 20, the left closure member 60 may be released from the right closure member 50 to open the garment 10.

Instead of opening the garment 10 by unzipping the zipper arrangement 12 as described above, the wearer may alternatively open the garment using a quick release feature. In particular, with reference to FIGS. 6 and 7, when using the quick release feature of the zipper arrangement, the wearer first grasps the front right portion 22 and the front left portion 24 of the garment 10 near the zipper closure 20. The wearer then presses the quick release button 54 on the zipper closure 20, allowing the left closure member 60 to release from the right closure member 50. After releasing the left closure member 60 from the right closure member 50, the wearer pulls the opposing garment portions 22, 24 apart, as noted by arrows 26 and 28 in FIG. 7. This action causes the teeth 34, 44 on the upper portion 14 of the zipper arrangement 12 to pivot downward, and away from one another, as shown by arrows 90 and 92. This action also causes the teeth 34, 44 on the lower portion 16 of the zipper arrangement 12 to pivot upward, and away from each other, as shown by arrows 94 and 96. As the teeth 34, 44 are moved out of parallel on opposing sides 30, 40 of the zipper arrangement 12, the teeth 34 on the right side 30 progressively release from the teeth 44 on the left side 40. The progressive release of the interlocking teeth 34, 44 continues along the length of the zipper arrangement 12 until the upper and lower end stops 36 and 38 are reached at the ends of the zipper arrangement 12. If the sliders 70, 80 are not positioned at the end stops when the quick release action begins, the pulling apart movement (see arrows 26 and 28 in FIG. 7) tends to force the sliders 70, 80 to the end stops. As the sliders 70, 80 move into contact with the end stops, the final few teeth 34, 44 are moved out of parallel and released from their interlock relationship. As a result, the front right portion 22 of the garment 10 is released from the front left portion 24 of the garment 10, and the garment is opened.

The above described embodiment of the zipper arrangement 12 provides improved access to a zipper's starting point on a garment, which is particularly relevant on a large winter coat. By moving the starting point higher up on the garment 10, it is easier for the wearer to reach, view and interact with the zipper arrangement 12. In particular, the wearer may simply bend his or her arms in order to bring the hands to the middle of the torso and access the zipper pulls 74, 84 and closure 20. The zipper arrangement also provides an interesting visual effect as the user opens and closes the garment. Moreover, the quick release feature of the zipper arrangement 12 allows the wearer to more quickly open the garment, when desired.

While one embodiment of the zipper arrangement 12 with a zipper closure in the middle portion of the garment is disclosed above with reference to FIGS. 1-7, it will be recognized that numerous alternative embodiments of the zipper closure are possible. For example, in the alternative embodiments shown in FIGS. 8-10, the zipper closure 20 includes an automatic alignment feature for the two parts of the zipper closure 20. As described in further detail below, each of the zipper closures 20 includes a left closure member 150 and a right closure member 160. Complimentary angular surfaces are provided on each of the left and right closure members 150, 160. Magnets installed in the left and right closure members facilitate easy and proper alignment of the left and right closure members 150, 160.

Figure 8A:
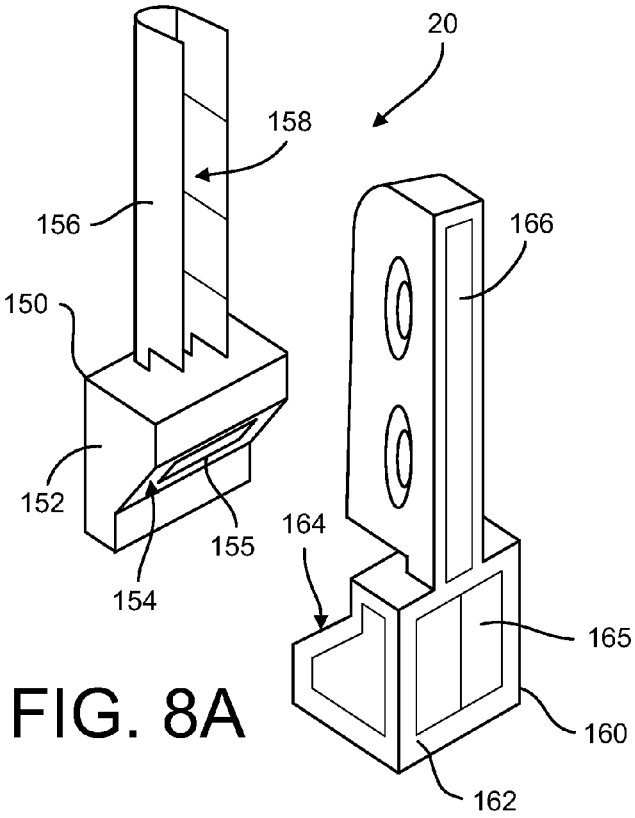
FIG. 8A shows a perspective view of a zipper coupling with a magnetic alignment system for use with the zipper arrangement of FIG. 1.

With reference to FIG. 8A, a zipper closure arrangement is shown including a right closure member 150 and a left closure member 160. The right closure member 150 is configured for connection to the right tape 32 of the zipper arrangement 12, and the left closure member 160 is configured for connection to the left tape 42 of the zipper arrangement 12. The right closure member 150 includes a base block member 152 with an angular surface 154 that faces downward and to the left. A magnet 155 of a first polarity (e.g., north pole) is installed in the angular surface 154 and retained within the block member 152. A column 156 extends upward from the block member 152. The column 156 includes an elongated groove 158.

The left closure member 160 also includes a base block member 162 with an angular surface 164. The angular surface 164 of the left block member 162 faces upward and to the right such that it is complimentary to the angular surface 154 of the right block member 152. A magnet 165 of a second polarity (e.g., south pole) is installed in the angular surface 164 and retained within the block member 162. A column 166 extends upward from the block member 162. The column 166 on the left closure member 160 is configured to be received within the groove 158 of the column of the right closure member 150.

The magnets 155 and 166 are oriented such that the magnetic field lines pass perpendicularly out of the angled surfaces 154, 164. Accordingly, the opposing magnetic poles attract together at the angled surfaces 154, 164 and create a bond between the right closure member 150 and the left closure member 160. Furthermore, the placement of the magnets 155, 165 cause the left and right closure members 150, 160 to be properly aligned, allowing the user to easily insert the column 166 of the left closure member 160 into the groove 158 on the column 156 of the right closure member 150.

Figure 8B:
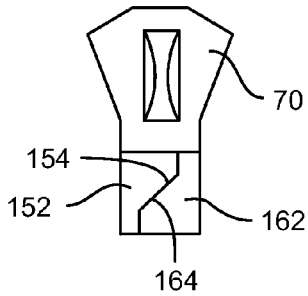
FIG. 8B shows a front view of the zipper closure of FIG. 8A with a slider in position over part of the zipper closure.

Before inserting the left closure member 160 into the right closure member 150, the upper slider 70 is first moved down over the column 156 of right closure member 150 with the bottom of the slider 70 resting on the base block member 152. The column 166 of the left closure member 160 is then inserted sideways through the slit in the slider 70 and into the groove 158 on the column of the right closure member 150. During this movement of the left column 166 toward the groove 158 on the right column 156, the magnets 155, 165 in the base block members 152, 162 attract and properly align the components of the right and left closure members 150, 160 for proper mating. FIG. 8B shows the upper slider 70 in position over the columns 156, 166 of the right and left closure members 150, 160. From this position, the upper slider 70 may be moved upward to interlock the teeth on the opposing tapes of the zipper arrangement 12. Although the closure arrangement of FIGS. 8A and 8B is only shown configured for use with the upper slider 70, the closure arrangement could also be configured for use with a lower slider. For example, by adding a lower portion to each of the left and right closure members 150, 160 that is symmetric to the upper portions shown in FIG. 8A, the closure arrangement may be configured for use with both the upper slider 70 and the lower slider 80 of the zipper arrangement.

Figure 9A:
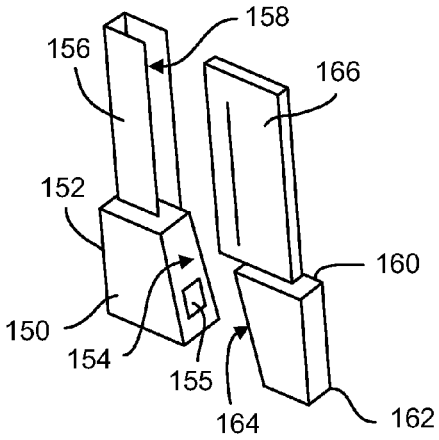
FIG. 9A shows a perspective view of an alternative embodiment of the zipper coupling with magnetic alignment system of FIG. 8A.
Figure 9B:
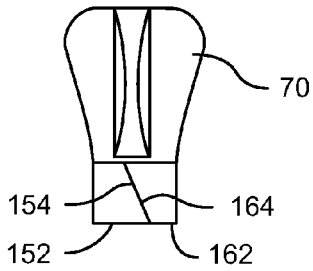
FIG. 9B shows a front view of the zipper closure of FIG. 9A with a slider in position over part of the zipper closure.

With reference to FIGS. 9A and 9B another alternative embodiment of a zipper closure arrangement is shown. The embodiment of FIGS. 9A and 9B is generally the same as that of FIGS. 8A and 8B, with the exception that the base block members 152, 162 are somewhat different in shape, and the columns 156, 166 are slightly different in shape. The embodiment of FIGS. 9A and 9B represents only one of numerous possible alternative arrangements for the zipper closure with a magnetic alignment system.

Figure 10A:
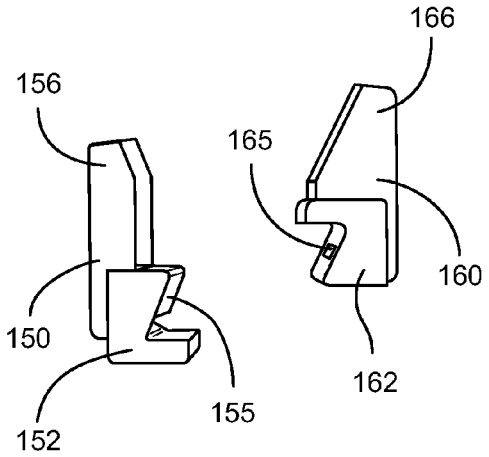
FIG. 10A shows a perspective view of an alternative embodiment of the zipper coupling with magnetic alignment system of FIG. 8A.
Figure 10B:
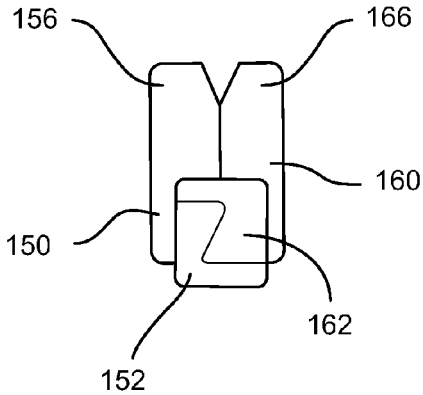
FIG. 10B shows a front view of the zipper coupling of FIG. 10A with two sides of the coupling engaged.

With reference to FIGS. 10A and 10B, yet another alternative embodiment of a zipper closure arrangement is shown. The embodiment of FIGS. 10A and 10B is again generally the same as that of FIGS. 8A and 8B, with the exception that the base block members 152, 162 are different in shape, and the columns 156, 166 are different in shape.

While the foregoing provides a few alternative embodiments of the zipper closure 20 for the zipper arrangement 12, it will be recognized that numerous other alternative embodiments for the zipper arrangement are possible, including additional alternative embodiments that relate to the zipper closure 20 and other portions of the zipper arrangement. For example, in one alternative embodiment, the zipper closure 20 may be moved away from a general middle portion of the garment 10 and be provided closer to the top or bottom portions of the garment 10.

Other examples of alternative embodiments of the zipper arrangement relate to the configuration of the zipper elements 34, 44. For example, instead of the zipper elements 34, 44 being "teeth" connected to the tapes 32, 42, as described in the embodiment of FIGS. 1-7, the zipper elements may be provided on a zipper coil, as will be recognized by those of skill in the art. Moreover, the zipper elements 32, 42 may be configured differently to provide different features. For example, the zipper elements 32, 42 may be teeth configured to add a tactile feel or other sensory feedback such as a unique sound as the sliders 70, 80 move along the zipper elements 34, 44. In addition, the teeth may have a unique shape or configuration to provide a unique look and feel to the zipper arrangement. Furthermore, while the teeth shows in FIGS. 5 and 7 have a particular shape to provide the quick release feature, different shaped teeth are possible, including different shaped teeth for the quick release feature or teeth that do not provide for the quick release feature, thus forcing the wearer to un-zip the zipper arrangement in order to open the garment.

In yet other embodiments of the zipper arrangement, the zipper sliders 70, 80 may be configured to provide anti-jamming or anti-snag features that prevent fabric from getting caught in the sliders. The sliders 70, 80 may include additional features that assist the user in aligning the sliders with the zipper closure 20, thus assisting the wearer of the garment 10 in joining the right and left tapes 32, 42 at the closure, and starting the zipping process. Additionally, the zipper pulls 74, 84 on the sliders 70, 80 may be locking or non-locking pulls. In one embodiment, one zipper pull, such as the upper zipper pull 74 may be locking while the lower zipper pull 84 may be non-locking.

The foregoing example embodiments are but a few of numerous possible embodiments for the zipper arrangement, and it will be recognized that numerous additional embodiments are also possible and the foregoing embodiments should not be considered as limiting in any way. It will also be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A method of fastening a first garment portion and a second garment portion comprising:

coupling a first member of a zipper closure to a second member of the zipper closure, the first member of the zipper closure connected to the first garment portion and the second member of the zipper closure connected to the second garment portion;

sliding a first slider in a first direction away from the zipper closure such that a first plurality of zipper elements are interlocked; and sliding a second slider in a second direction away from the zipper closure such that a second plurality of zipper elements are interlocked, the second direction being opposite the first direction;

releasing the first closure member from the second closure member;

moving the first garment portion away from the second garment portion; and progressively unlocking the first plurality of zipper elements and the second plurality of zipper elements without the use of the first slider or the second slider as the first garment portion is moved away from the second garment portion.

2. The method of claim 1 wherein progressively unlocking the first plurality of zipper elements and the second plurality of zipper elements comprises progressively moving interlocked zipper elements out of parallel such that the interlocked zipper elements release from each other.

3. The method of claim 1 wherein coupling the first member of the zipper closure to the second member of the zipper closure comprises magnetically coupling the first member of the zipper closure to the second member of the zipper closure.

4. The method of claim 1 wherein coupling the first member of the zipper closure to the second member of the zipper closure comprises coupling a mid-portion of the first garment portion to a mid-portion of the second garment portion.

5. A garment for the upper body comprising:

a first front fabric portion;

a second front fabric portion;

a zipper arrangement including a plurality of first zipper elements positioned along the first front fabric portion and a plurality of second zipper elements positioned along the second front fabric portion;

a zipper closure including a first closure member configured to be releasably coupled to a second closure member, the first closure member positioned on the first front fabric portion in a middle portion of the garment such that the plurality of first zipper elements includes a plurality of upper first zipper elements positioned above the first closure member and a plurality of lower first zipper elements positioned below the first closure member, and the second closure member positioned on the second front fabric portion in the middle portion of the garment such that the plurality of second zipper elements includes a plurality of upper second zipper elements positioned above the second closure member and a plurality of lower second zipper elements positioned below the second closure member;

a first slider positioned on an upper side of the zipper closure, the first slider configured to bring the upper first zipper elements into interlocking engagement with the upper second zipper elements when the first slider is engaged with the upper first zipper elements and the upper second zipper elements and moved in an upward direction, wherein the plurality of upper first zipper elements and the plurality of upper second zipper elements are configured such that the interlocking engagement is a quick release interlock such that the upper first zipper elements are configured for release from the upper second zipper elements without movement of the first slider; and a second slider positioned on a lower side of the zipper closure, the second slider configured to bring the lower first zipper elements into interlocking engagement with the lower second zipper elements when the second slider is engaged with the lower first zipper elements and the lower second zipper elements and moved in a downward direction, wherein the plurality of lower first zipper elements and the plurality of lower second zipper elements are configured such that the interlocking engagement is a quick release interlock such that the lower first zipper elements are configured for release from the lower second zipper elements without movement of the second slider.

6. The garment of claim 5 wherein the first closure member is configured to be magnetically coupled to the second closure member.

7. A garment configured to be worn on an upper body of a human, the garment comprising:

a first side portion configured to cover a first side of the upper body;

a second side portion configured to cover a second side of the upper body;

a zipper arrangement configured to fasten the first side portion to the second side portion, the zipper arrangement comprising:

a plurality of first zipper elements positioned along the first side portion;

a plurality of second zipper elements positioned along the second side portion;

a zipper closure including a first closure member configured to be releasably coupled to a second closure member, the first closure member and the second closure member positioned on a mid-portion of the garment, the first closure member including a catch configured to engage the second closure member and couple the first closure member to the second closure member, the zipper closure further including a release configured to decouple the first closure member and the second closure member when the release is activated;

a first slider positioned on an upper side of the zipper closure, the first slider configured to slide along the first plurality of zipper elements and the second plurality of zipper elements on an upper-portion of the garment; and a second slider positioned on a lower side of the zipper closure, the second slider configured to slide along the first plurality of zipper elements and the second plurality of zipper elements on a lower-portion of the garment wherein the plurality of first zipper elements are configured to engage the plurality of second zipper elements in a quick release interlock such that the first zipper elements may be released from the second zipper elements without the use of the first slider or the second slider.

8. The garment of claim 7 wherein the first closure member includes a retaining structure, wherein the second closure member includes an insertion member configured to be inserted into the retaining structure, and wherein the release is positioned on the first closure member.

9. The garment of claim 7 wherein the first closure member and the second closure member are configured to be magnetically coupled.

10. The zipper arrangement of claim 7 wherein the catch on the first closure member is configured to retain a portion of the second closure member within the first closure member.

11. The zipper arrangement of claim 7 wherein the quick release interlock between the plurality of first zipper elements and the plurality of second zipper elements is configured such that (i) the plurality of first zipper elements remain interlocked with the plurality of second zipper elements when the plurality of first zipper elements are substantially parallel to the plurality of second zipper elements, and (ii) the plurality of first zipper elements release from the plurality of second zipper elements when the plurality of first zipper elements are substantially non-parallel with respect to the plurality of second zipper elements.

12. A garment configured to be worn on an upper body of a human, the garment comprising:

a first side portion configured to cover a first side of the upper body;

a second side portion configured to cover a second side of the upper body;

a zipper arrangement configured to fasten the first side portion to the second side portion, the zipper arrangement comprising a plurality of first zipper elements positioned along the first side portion;

a plurality of second zipper elements positioned along the second side portion;

a zipper closure including a first closure member configured to be releasably coupled to a second closure member, the first closure member and the second closure member positioned on a mid-portion of the garment, the first closure member including a catch configured to engage the second closure member and couple the first closure member to the second closure member, the zipper closure further including a release configured to decouple the first closure member and the second closure member when the release is activated;

a first slider positioned on an upper side of the zipper closure, the first slider configured to slide along the first plurality of zipper elements and the second plurality of zipper elements on an upper-portion of the garment; and a second slider positioned on a lower side of the zipper closure, the second slider configured to slide along the first plurality of zipper elements and the second plurality of zipper elements on a lower-portion of the garment;

wherein the plurality of first zipper elements are provided on a first tape coupled to the first fabric portion and the plurality of second zipper elements are provided on a second tape coupled to the second fabric portion;

wherein the zipper closure divides the first tape and the second tape into and upper portion and a lower portion, wherein the first slider is configured to slide upward along the upper portion of the first tape and the second tape and bring the plurality of first zipper elements and the plurality of second zipper elements on the upper portion of the first tape and the second tape into interlocking engagement, and wherein the second slider is configured to slide downward along the lower portion of the first tape and the second tape and bring the plurality of first zipper elements and the plurality of second zipper elements on the lower portion into interlocking engagement, and wherein the plurality of first zipper elements are configured for release from the interlocking engagement with the second zipper elements without the use of the first slider or the second slider when the first closure member is decoupled from the second closure member and the first tape is moved in an opposite direction from the second tape.

* * * * *